United States Patent [19]

Iijima et al.

[11] 3,980,000

[45] Sept. 14, 1976

[54] CONTROL SYSTEM FOR A HYDRAULIC CLAMPING DEVICE

[75] Inventors: Katsuhiko Iijima; Katsumasa Jomen, both of Sagamihara, Japan

[73] Assignee: Mitsubishi Jukogyo Kabushiki Kaisha, Tokyo, Japan

[22] Filed: July 29, 1974

[21] Appl. No.: 492,845

[30] Foreign Application Priority Data

Aug. 24, 1973 Japan ..... 48-94299

[52] U.S. Cl. ..... 91/411 R; 91/445; 91/447; 91/454; 91/461; 137/523; 137/596.14; 214/138 C

[51] Int. Cl.[2] ..... E02F 3/28; F15B 11/16; F15B 13/08

[58] Field of Search ..... 91/411, 445, 454, 457, 91/461, 304, 358 A, 447, 411 R; 137/523, 624.27, 596.14; 251/73, 297; 92/24, 146, 161; 214/138 C

[56] References Cited

UNITED STATES PATENTS

| | | | |
|---|---|---|---|
| 2,515,395 | 7/1950 | Court | 91/447 X |
| 2,547,861 | 4/1951 | Fletcher | 91/447 X |
| 3,030,929 | 4/1962 | Hipp | 91/461 X |
| 3,088,489 | 5/1963 | Stacey | 251/297 X |
| 3,397,620 | 8/1968 | Skelton et al. | 92/24 |
| 3,429,550 | 2/1969 | Grove | 92/30 X |
| 3,608,930 | 9/1971 | Moriceau et al. | 214/138 C |
| 3,792,640 | 2/1974 | Shore | 91/358 A |
| 3,800,669 | 4/1974 | Distler | 91/411 R |

FOREIGN PATENTS OR APPLICATIONS

| | | | |
|---|---|---|---|
| 632,201 | 12/1961 | Canada | 91/445 |

*Primary Examiner*—Irwin C. Cohen
*Attorney, Agent, or Firm*—Cushman, Darby & Cushman

[57] ABSTRACT

The invention is a control system for a hydraulic clamping device adapted to be connected to a source of pressurized hydraulic fluid and to a hydraulically operated clamp, which system comprises a path for supply of pressurized fluid to and from the clamp, a check valve in the said path, a hydraulically operated pilot piston movable between a non-actuating position and an actuating position in which it urges open the check valve, means to hold the pilot piston in the actuating position and thereby maintains the check valve open and a switching means for controlling the supply of pressurized fluid to and from the pilot piston, the switching means being capable of occupying a neutral position, a position in which pressurized fluid is supplied to the pilot piston to urge the pilot piston to the actuating position to open the check valve and a position in which pressurized fluid is supplied to the pilot piston to return the pilot piston to the non-actuating position and thereby permit the check valve to close.

1 Claim, 7 Drawing Figures

CONTROL SYSTEM FOR A HYDRAULIC CLAMPING DEVICE

This invention relates to a control system for a hydraulic clamping device and more particularly, but not exclusively, is concerned with a control system for a hydraulic clamping device in a construction machine, especially in a side slide type of back-hoe or the like.

In a known hydraulic circuit for a side slide type of back-hoe having a hydraulic clamping device provision is generally made for the prevention of escape of pressurized oil in a clamping cylinder by the use of a check valve, and when it is desired to release the pressurised oil from the clamping cylinder, the check valve is opened by means of a pilot piston, a pin or the like. However, one disadvantage of this known arrangement is that it is necessary to hold an operating lever continuously and that the force required to operate the lever is large.

According to the present invention, there is provided a control system for a hydraulic clamping device adapted to be connected to a source of pressurised hydraulic fluid and to a hydraulically operated clamp, which system comprises a path for supply of pressurised fluid to and from the clamp, a check valve in the said path, a hydraulically operated pilot piston movable between a non-actuating position and an actuating position in which it urges open the check valve, means to hold the pilot piston in the actuating position and thereby maintains the check valve open and a switching means for controlling the supply of pressurised fluid to and from the pilot piston, the switching means being capable of occupying a neutral position, a position in which pressurised fluid is supplied to the pilot piston to urge the pilot piston to the actuating position to open the check valve and a position in which pressurised fluid is supplied to the pilot piston to return the pilot piston to the non-actuating position and thereby permit the check valve to close.

Figure 1:
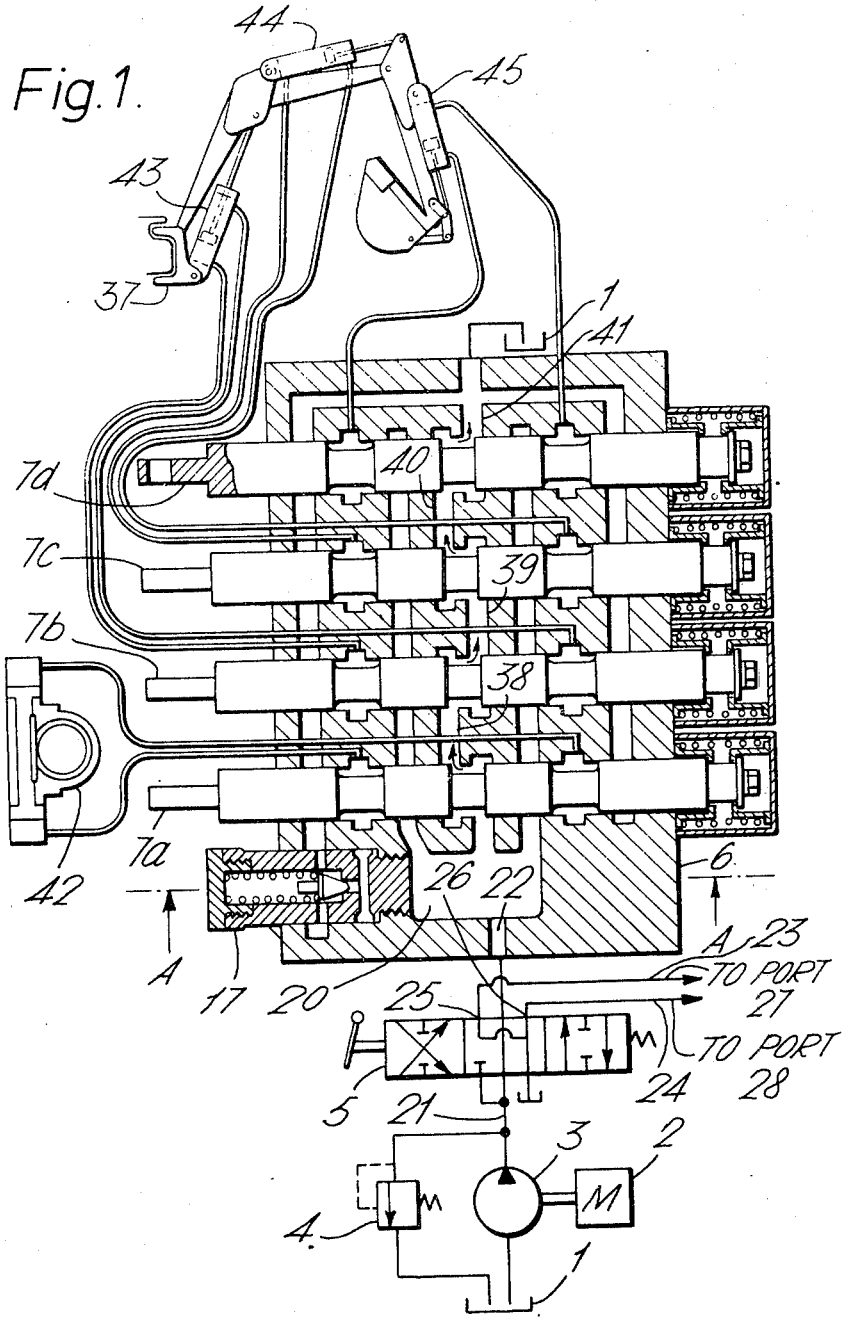

For a better understanding of the invention, and to show how the same may be carried into effect reference will now be made, by way of example, to the accompanying drawings, in which:

FIG. 1 is a diagrammatic view, partially in cross-section of a hydraulic circuit of a back-hoe excavating apparatus embodying the present invention.

Figure 2:
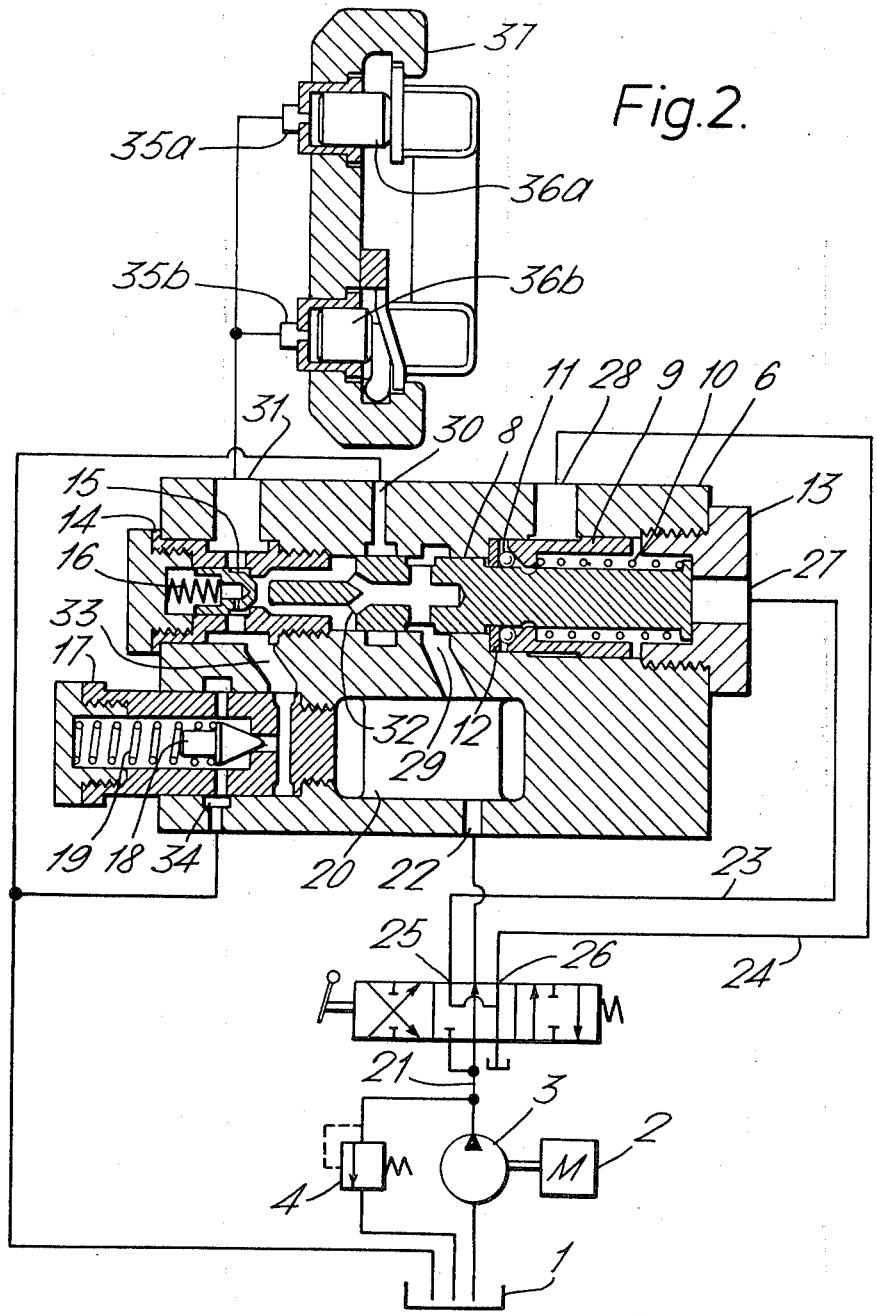
Figure 3:
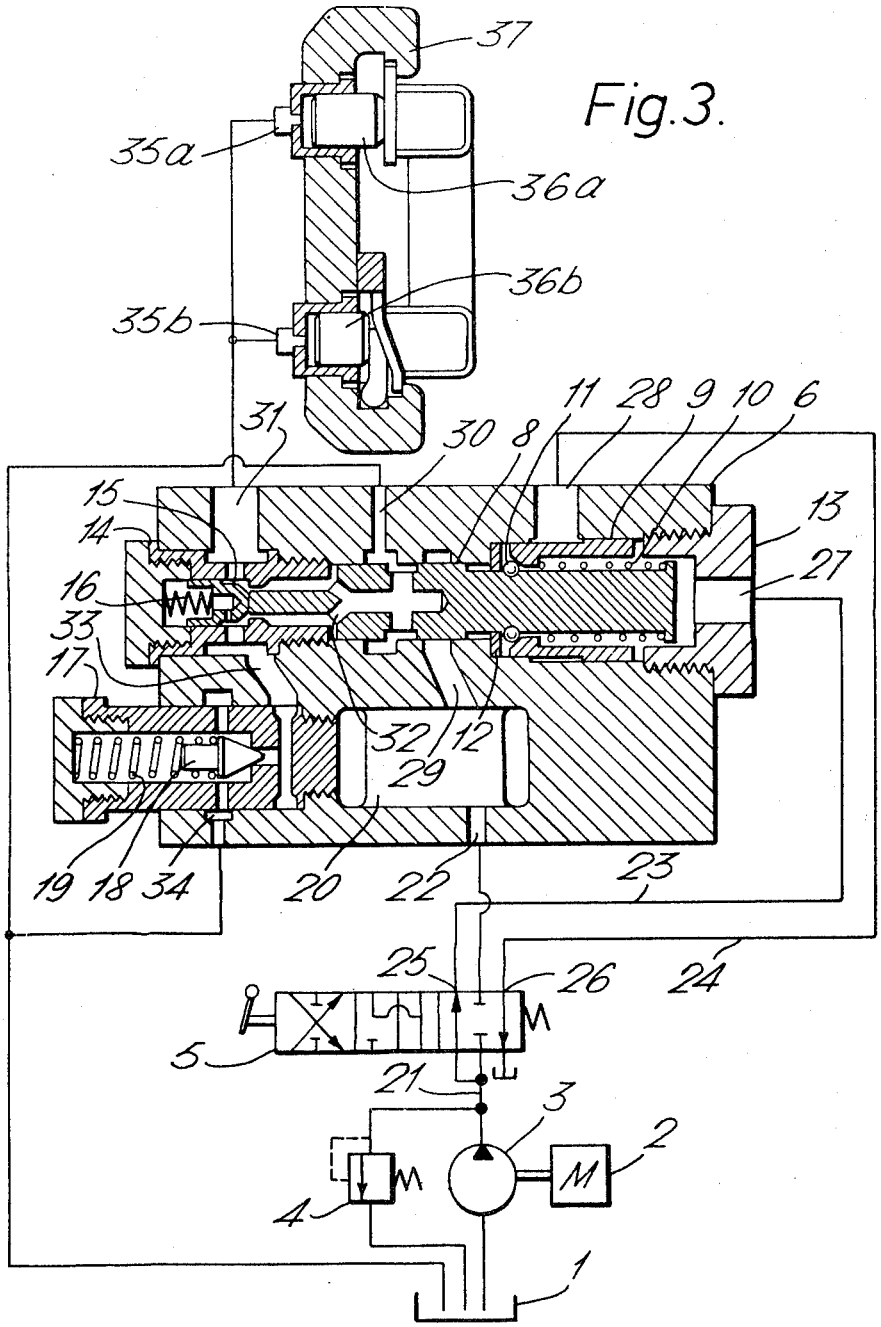
Figure 4:
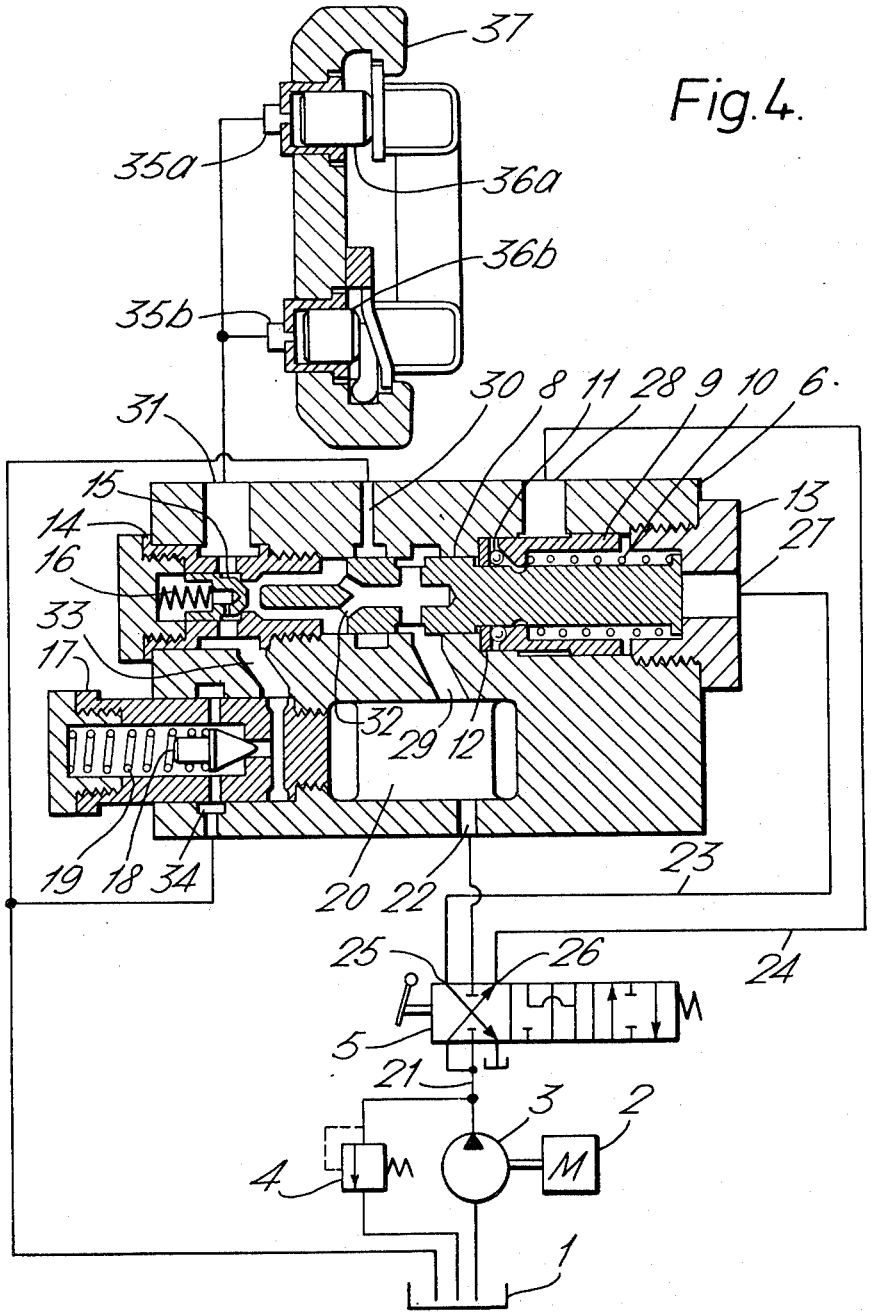

FIGS. 2 to 4 show cross-sectional views of the control device taken along line A–A in FIG. 1 above which are cross-sectional views of a hydraulic clamping device and below which are associated hydraulic circuit diagrams depicted schematically. These three Figures illustrate three different operating states, that is, a neutral state in FIG. 2, a releasing state in FIG. 3, and a restoring state in FIG. 4, FIGS. 5 to 7 show an alternative embodiment of the present invention, illustrating three different operating states corresponding to FIGS. 2 to 4, respectively, that is, a neutral state in FIG. 5, a releasing state in FIG. 6 and a restoring state in FIG. 7.

Reference numeral 1 designates an oil tank, numeral 2 designates a prime motor, numeral 3 designates a pump, numeral 4 designates a pressure relief valve for regulating the oil pressure in the hydraulic circuit and numeral 5 designates a flow-direction control or slidable spool valve for controlling actuation of a pilot piston 8 in a hydraulic clamping circuit. Reference numeral 6 designates a housing having a lower part enclosing spool valves 7*a*, 7*b*, 7*c* and 7*d* and a body 17 of a safety valve and an upper part enclosing a pilot piston 8, a body 14 of a check valve, a release piston 9, a spring 10 positioned between the pilot piston 8 and the release piston 9, balls 11 and seats 12 for the balls 11. Reference numeral 15 designates a pilot-operated check valve which co-operates with a spring 16 enclosed within the check valve body 14 in the housing 6, and numeral 18 designates a safety valve disposed under the check valve body 14 and co-operating with a pressure regulating spring 19 enclosed within the safety valve body 17 in the housing 6. Reference numeral 20 (FIGS. 1 and 2) designates a pressurized oil chamber which communicates with conduits 21 and 22 when the slidable spool valve 5 is at its neutral position. The chamber 20 also communicates with a hydraulic path 29 in the upper part of the housing, and in the lower part of the housing the chamber 20 communicates, via center by-passing hydraulic paths 38, 39, 40 and 41, with the oil tank 1 as shown in FIG. 1. Reference numeral 23 designates a conduit communicating with a port 25 of the slidable spool valve 5 and a port 27 of a plug 13 screwed into the housing 6. Numeral 24 designates another conduit communicating with a port 26 of the slidable spool valve 5 and a port 28 of the housing 6. Numerals 30 and 34 designate return hydraulic paths. Numeral 31 designates a port communicating with a hydraulic path 33 and with pressurized oil-ports 35*a* and 35*b* for pistons 36*a* and 36*b*, respectively. Numeral 32 designates a pressurized oil chamber the pressure within which varies in response to the switching motion of the pilot piston 8, and which communicates with the hydraulic path 29 when the apparatus is in the configuration as shown in FIG. 2. Reference numeral 37 (FIGS. 1 and 2) designates a movable frame of a back-hoe excavating apparatus. Numeral 42 designates a swing motor of such a back-hoe. Numeral 43 designates a boom cylinder, numeral 44 designates a dipper arm cylinder, and numeral 45 designates a bucket cylinder.

When the slidable spool valve 5 is in a neutral position as shown in FIG. 1 and the other respective spool valves 7*a*, 7*b*, 7*c* and 7*d* are in their neutral positions, the oil in the tank 1 is fed by the pump 3 driven by the prime motor 2 through the hydraulic paths 21 and 22 to the pressurized oil chamber 20. The oil is then further passed through the center by-passing hydraulic paths 38, 39, 40 and 41 and is thence returned to the tank 1, as shown in FIG. 1. Then spool valve 7*a* is pushed in, i.e. to the right as shown in FIG. 1, while the slidable spool valve 5 is maintained at its neutral position as shown in FIGS. 1 and 2, the swing motor 42 is urged to rotate clockwise as shown. Simultaneously therewith, the hydraulic pressure in the hydraulic path 29 as well as in the pressurized oil chamber 32 in the pilot piston 8 which communicates with the pressurized oil chamber 20 becomes equal to the hydraulic pressure on the higher pressure side of the swing motor 42. The check valve 15 tends to open under the action of this hydraulic pressure, allowing pressurized oil to be fed through the port 31 to the ports 35*a* and 35*b* which thus urge the pistons 36*a* and 36*b* to clamp the movable frame 37 in a fixed position. Following this operation of the swing motor 42, if the spool valve 7*a* is restored to its neutral position and if the spool valve 7*b* is pushed in, i.e. to the right, from the position shown in FIGS. 1 and 2, the boom cylinder 43 is urged to extend. Then, although the pressurized oil chamber 20 communicates with the hydraulic paths 29 and 32 as in the above-described operation, the check valve 15 opens only when the hydraulic pressure of the pressurized oil fed to the boom cylinder 43 becomes greater than the maximum hydraulic pressure produced while the swing motor 42 was being supplied with oil. (In other words, the check valve 15 opens only when the hydraulic pressure in chamber 32 becomes greater than the clamping hydraulic pressure which was established during the afore-mentioned operation of the swing motor 42 and which is retained by the check valve 15). At this point, with the check valve 15 open, the hydraulic pressure acting on the pistons 36*a* and 36*b* is equal to the hydraulic pressure acting on the boom cylinder 43. Thus, it is possible to clamp the pistons 36*a* and 36*b* with the maximum hydraulic pressure achieved during operations of the actuators 42, 43, 44 and 45 controlled by the spool valves , a. 7*b*, 7*c* and 7*d*, respectively.

When a large external force is applied to the pistons 36*a* and 36*b*, thereby generating an excessive hydraulic pressure at the clamping cylinder ports 35*a* and 35*b*, the pressurized oil in the port 31 and the hydraulic path 33 communicating with the cylinder ports 35*a* and 35*b* urges the safety valve 18 against the regulated load of the spring 19 so that the hydraulic path 33 communicates with a return hydraulic path 34. Thus, with this device provision is made to avoid the application of excessive pressure to the clamping cylinder ports 35*a* and 35*b*. With the spool valve 5 displaced leftwards as shown in FIG. 3, the conduits 21 and 22 are disconnected from each other, and the pressurized oil fed from the pump 3 is passed through the conduit 21, the port 25 and the conduit 23 to the port 27 of the plug 13. The pressurised oil pushes and displaces the pilot piston 8 leftwardly against the resistance of the spring 10, so that the pressurised oil chamber 32 in the pilot piston 8 becomes disconnected from the hydraulic path 29, but becomes connected to the return hydraulic path 30. Further, the left hand end of the pilot piston 8 pushes the check valve 15 leftwardly against the resistance of the spring 16 so that the pressurised oil chamber 32 communicating with the return hydraulic path 30 is connected to the port 31 communicating with the cylinder ports 35*a* and 35*b*, with the effect that the hydraulic pressure in the cylinder ports 35*a* and 35*b* is lowered so that the clamping of the movable frame 37 is released. simultaneously, the leftward displacement of the pilot piston 8 causes the balls 11 to enter a groove on the circumferential surface of the piston 8. In this groove the balls 11 co-operate with a conical surface of the release piston 9 and a vertical surface of the plate 12 to provide a means for holding the piston 8. Then, since the force retaining the piston 8 in this position with the holding means is greater than the resilient force of the springs 10 and 16 tending to restore the pilot piston 8 rightwardly, the established releasing configuration, in which the clamping is released, cam be retained indefinitely.

In order to restore the clamping state, the spool valve 5 is pushed to the right as shown in FIG. 4. With the spool valve 5 in this position, pressurized oil is passed through the conduit 21, the port 26 and the conduit 24 to the port 28, causing the release piston 9 which is pushing the balls 11 to be displaced rightwardly to bear more firmly against the spring 10, so that the force exerted by the release piston 9 on the balls 11 disappears. The pilot piston 8 is now displaced rightwardly by the resilient force of the spring 10 since the port 27 communicates through the port 25 with the tank 1, and thus the state shown in FIG. 4 is realised. Thereafter, by returning the spool valve 5 to its neutral position the state shown in FIG. 2, where the control system is ready to operate to clamp the movable frame 37 is restored. In this way, the hydraulic clamping device can be controlled by a remote control system which is simply operated by the slidable spool valve 5.

Figure 5:
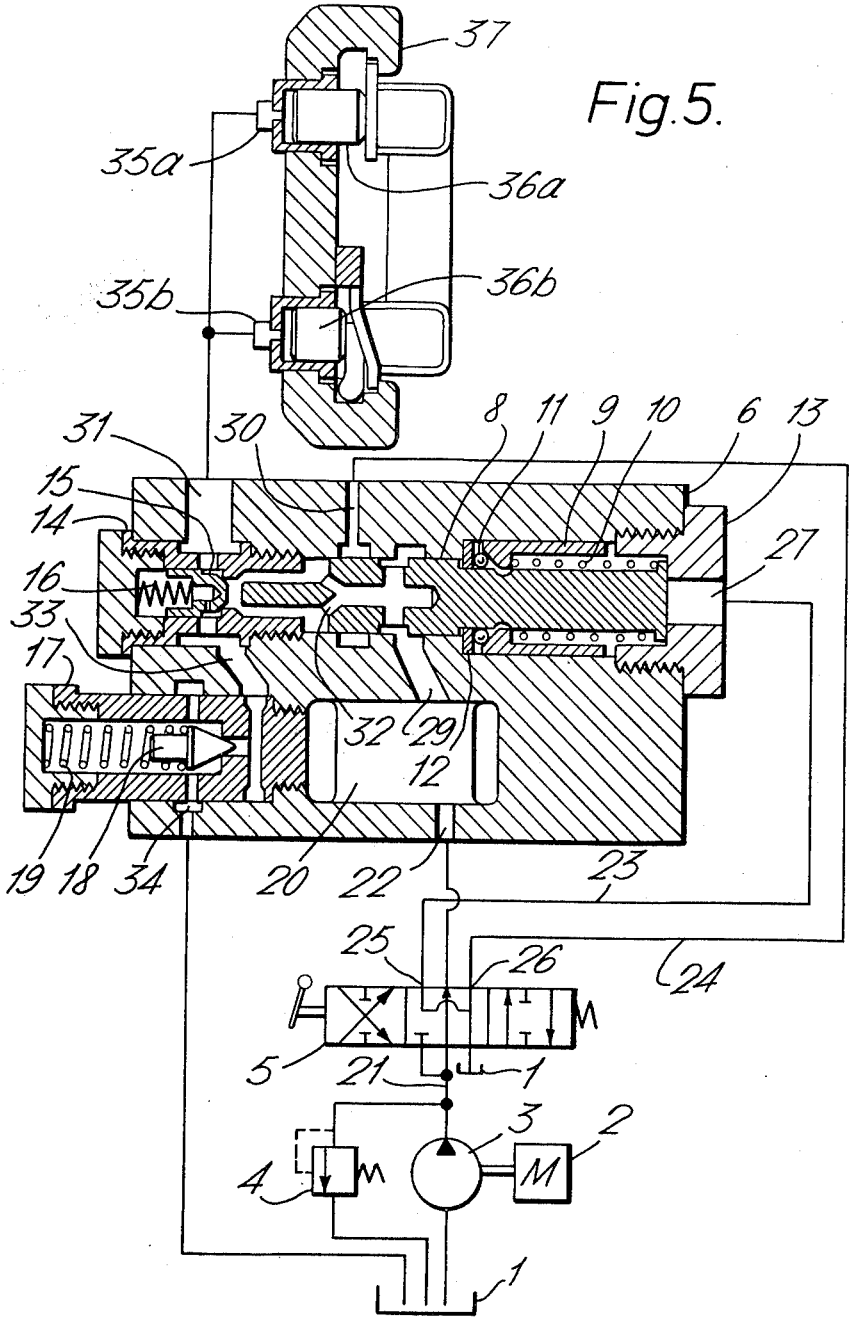
Figure 6:
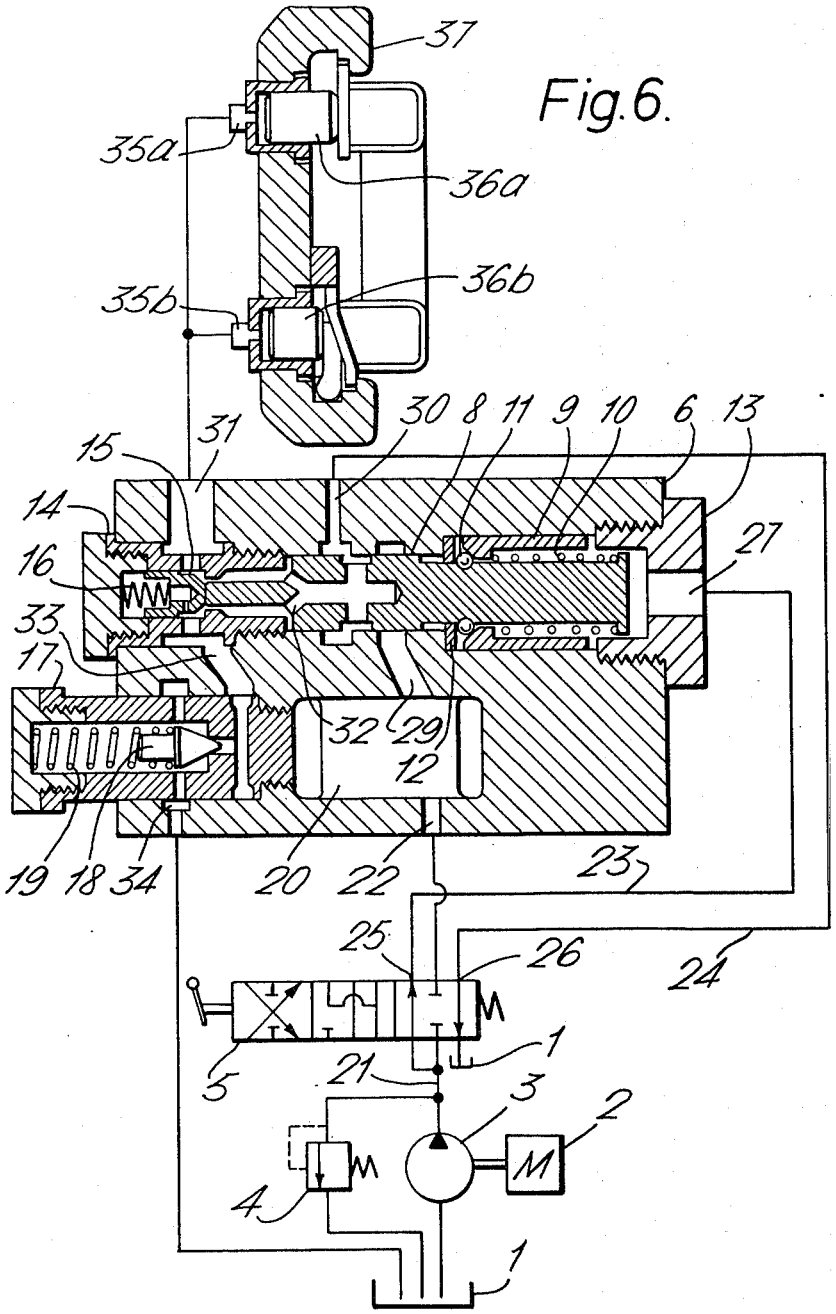
Figure 7:
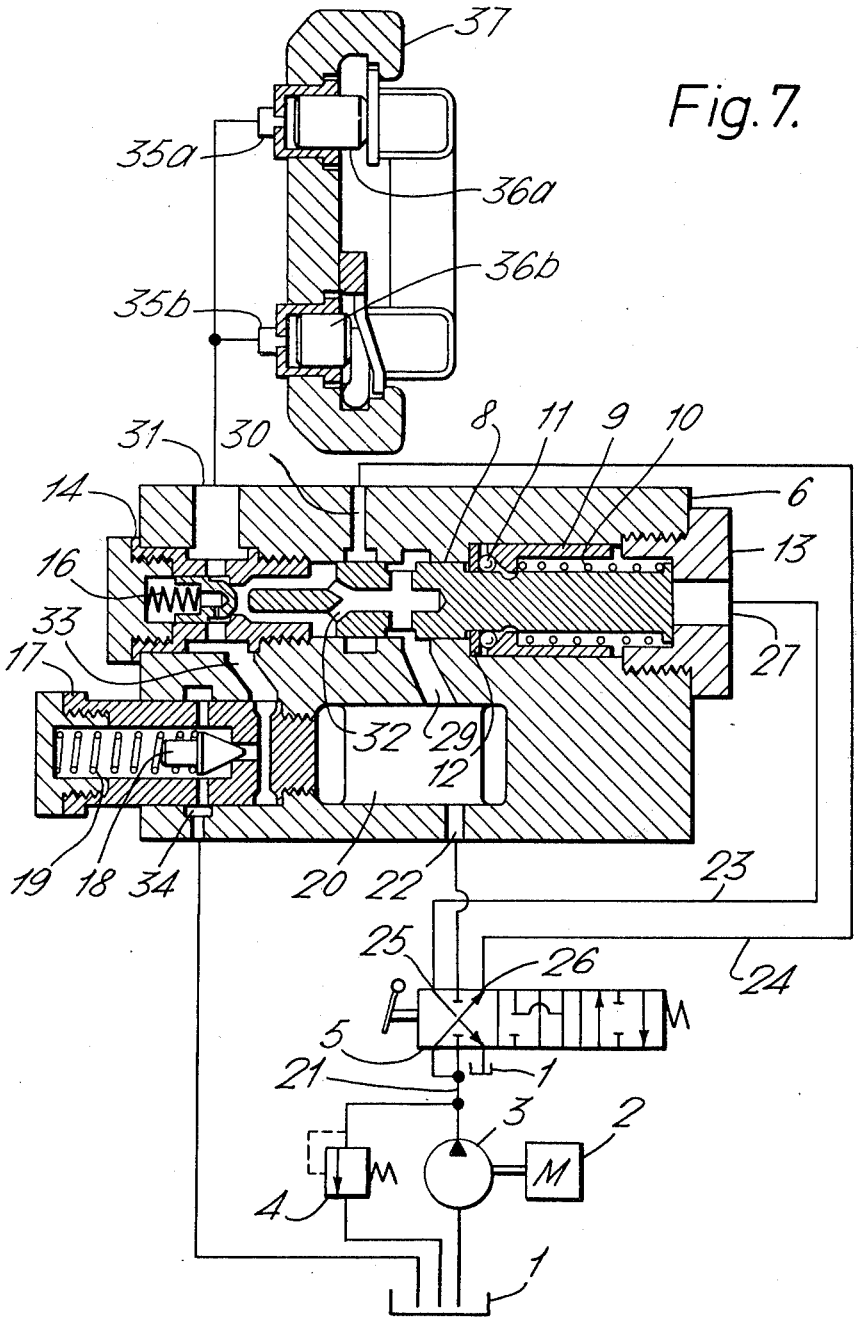

Another embodiment of the present invention is illustrated in FIGS. 5, 6, and 7. The structure according to this alternative embodiment is substantially the same as that of the previously described embodiment, and so only the differences between these embodiments will be described hereafter. More specifically, in this alternative embodiment the structure is such that the port 30 and the port 26 of the slidable spool 5 are coupled through a conduit 24 and the port 28 provided in the previously described embodiment is omitted.

As shown in FIG. 5, when the slidable spool valve 5 is in the neutral position, the oil in the tank 1 is fed through the hydraulic paths 21 and 22 to the pressurized oil chamber 20 by the pump 3 (which is in turn driven by the prime motor 2) and after passing through the center by-passing hydraulic paths 38, 39, 40 and 41 of the valves in the apparatus shown in FIG. 1 it is returned to the tank 1. Subsequently, when the spool valves 7*a*, 7*b*, 7*c* and 7*d* are arbitrarily operated while the slidable spool valve 5 is maintained in the neutral state, it is possible to clamp the pistons 36*a* and 36*b* with the maximum hydraulic pressure obtained during the operations of the actuators 42, 43, 44 and 45 in a similar manner to that described with reference to the above-described first embodiment.

If the slidable spool valve 5 is displaced leftwardly as shown in FIG. 6, then the conduit 21 and the conduit 22 are disconnected from each other, and the pressurised oil fed from the pump 3 is passed through the conduit 21 via the port 25 and the conduit 23 to the port 27 of the plug 13. The pressurised oil pushes and displaces the pilot piston 8 leftwardly against the resistance of the spring 10, so that the pressurized oil chamber 32 in the pilot piston 8 is disconnected from the hydraulic path 29, and instead communicates through the port 30 with the conduit 24, which in turn communicates with the tank 1 via the port 26. The left end of the pilot piston 8 pushes and opens the check valve 15, allowing the hydraulic pressure in the cylinder ports 35*a* and 35*b* to fall with the consequent release of the movable frame 37. The configuration in which the clamping is released is maintained with the holding means comprising the release piston 9 and the balls 11. Subsequently, in order to restore the clamping state, the slidable spool valve 5 is pushed in, i.e. rightwardly as shown in FIG. 7. In this position, the conduit 21 communicates with the conduit 24 via the port 26, and pressurized oil is fed to the port 30. With the pilot piston 8 in the position shown in FIG. 6, the pressurized oil is passed through the pressurized chamber 32 to the cylinder ports 35*a* and 35*b* and simultaneously generates a thrust force pushing the pilot piston 8 rightwardly. This thrust force overcomes the holding force exerted by the holding means comprising the release piston 9 and the balls 11 and results in displacement of the pilot piston 8 up to its rightmost position, and thus the configuration shown in FIG. 7 is attained. Thereafter, by returning the slidable spool valve 5 to its neutral position, the configuration shown in FIG. 5, in which the clamping control system is ready to operate to clamp the movable frame 37 is once again restored.

In the control system according to the present invention, because the hydraulic clamping circuit is provided with a pilot-operating type of check valve including a pilot piston which comprises holding means as well as hydraulic path switching means as described above, there exist the advantages that (1) the operations of clamping and releasing the clamping mechanism can be carried out without continuously holding a control lever (2) that the operating force required to operate the mechanism can be made small and (3) that a remote control is possible. In addition, since an overload preventing safety valve is provided in the clamping cylinder circuit, it is possible to undertake excavating work under optimum clamping conditions.

While the invention has been described above in connection with two preferred embodiments illustrated in the accompanying drawings, it is intended that the present invention should not be limited to these specific embodiments but that many changes and modifications may be made thereto without departing from the scope of the invention as defined in the following claims.

What is claimed is:

1. A control system for a hydraulically actuated apparatus comprising, at least, a first expansible hydraulic motor for actuating a clamping device and a second hydraulic motor actuatable separately from said first motor, said control system comprising:

fluid distribution means including:

manually movable valve means for selectively supplying fluid under pressure along a first hydraulic path from a source to said fluid distribution means, said fluid distribution means having, at least, one valve member in said first hydraulic path movable between an actuated position, wherein flow of fluid under pressure to said second hydraulic motor is permitted, and a deactuated position, wherein said flow of fluid to said second hydraulic motor is prevented, said fluid distribution means further including a second hydraulic path communicating with said first expansible hydraulic motor and said first hydraulic path at a point between said manually movable valve means and said one valve member, check valve means in said second hydraulic path, said check valve means being movable between an open and closed position in said second hydraulic path, resilient means for constantly urging said check valve means towards said closed position, a fluid actuated pilot piston in said second hydraulic path movable between a deactivated position, wherein fluid flow through said second hydraulic path to said first expansible motor is controlled by said check valve means, and an activated position, wherein said pilot piston engages and holds open said check valve means, means biasing said pilot piston towards said deactivated position, said check valve means being movable to said open position when both said movable valve means supplies fluid under pressure to said fluid distribution means and said pilot piston is in its said deactivated position so that the pressure of the fluid supplied to said first hydraulic motor will be the same as the pressure of the fluid supplied to said second hydraulic motor through said one valve member, fluid operated locking means for holding said pilot piston in its said activated position when said pilot piston moves into its activated position, said fluid distribution means further including a fluid return path and said pilot piston having means for closing said second hydraulic path and passage means associated therewith for establishing a drain path from said first expansible hydraulic motor to said fluid return path when said pilot piston is in its said activated position, said manually movable valve means being movable to one position to supply fluid under pressure to said pilot piston to move said pilot piston from each deactivated to said activated position and to another position to supply fluid to said locking means wherein said locking means is released and said pilot piston is moved by said biasing means to said deactivated position.

* * * * *